US008539767B2

(12) United States Patent
O'Kane et al.

(10) Patent No.: US 8,539,767 B2
(45) Date of Patent: Sep. 24, 2013

(54) EXHAUST TREATMENT SYSTEM FOR AN INTERNAL COMBUSTION ENGINE

(75) Inventors: Kimberly O'Kane, Davisburg, MI (US); Chijou Wang, Farmington Hills, MI (US); Gary Clark, II, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 196 days.

(21) Appl. No.: 13/182,054

(22) Filed: Jul. 13, 2011

(65) Prior Publication Data

US 2012/0234003 A1 Sep. 20, 2012

Related U.S. Application Data

(60) Provisional application No. 61/453,346, filed on Mar. 16, 2011.

(51) Int. Cl.

| | |
|---|---|
| ***F02D 23/00*** | (2006.01) |
| ***F01N 3/02*** | (2006.01) |
| ***F01N 5/02*** | (2006.01) |
| ***F01N 1/00*** | (2006.01) |
| ***F01D 25/24*** | (2006.01) |

(52) U.S. Cl.
USPC ..... 60/602; 60/320; 60/321; 60/322; 60/323; 415/214.1

(58) Field of Classification Search
USPC ..... 60/602, 320–323; 417/406; 403/335; 415/214.1
See application file for complete search history.

(56) References Cited

U.S. PATENT DOCUMENTS

| | | | | |
|---|---|---|---|---|
| 3,388,550 | A * | 6/1968 | Binek | 415/208.2 |
| 4,122,673 | A * | 10/1978 | Leins | 60/274 |
| 5,201,965 | A * | 4/1993 | Ohtsuka et al. | 148/333 |
| 6,739,832 | B2 * | 5/2004 | Hansen et al. | 415/159 |
| 7,267,117 | B2 * | 9/2007 | Tonetti et al. | 123/704 |
| 2008/0127638 | A1 * | 6/2008 | Vaarkamp et al. | 60/297 |

FOREIGN PATENT DOCUMENTS

DE 19654026 A1 * 6/1998

OTHER PUBLICATIONS

Machine English Translation of Fuoss (Pub. No. DE19654026 A1), published on Jun. 25, 1998.*

* cited by examiner

*Primary Examiner* — Thai Ba Trieu
*Assistant Examiner* — Shafiq Mian
(74) *Attorney, Agent, or Firm* — Cantor Colburn LLP

(57) ABSTRACT

An exhaust system comprises an exhaust driven turbocharger having an outlet and a flanged portion that extends about the outlet, an exhaust treatment device comprising a canister having an inlet cone that includes an integral inlet flange defining an the inlet opening configured to define a seal with the flanged portion that extends about the outlet of the turbocharger and a substrate disposed within the canister through which the exhaust gas flows. An exhaust gas passage, fluidly couples the turbocharger and the exhaust treatment device and allows for the passage of exhaust gas therebetween and a flow modifier comprising a radially inwardly extending wall portion extends from an inner wall of the exhaust gas passage and directs the exhaust gas away from an outer radius of the exhaust gas passage to evenly distribute the exhaust gas across the an inlet face of the substrate.

12 Claims, 4 Drawing Sheets

EXHAUST TREATMENT SYSTEM FOR AN INTERNAL COMBUSTION ENGINE

CROSS-REFERENCES TO RELATED APPLICATIONS

This patent application claims priority to U.S. Provisional Patent Application Ser. No. 61/453,346 filed Mar. 16, 2011, which is incorporated herein by reference in its entirety.

FIELD OF THE INVENTION

Exemplary embodiments of the invention relate to exhaust treatment systems for internal combustion engines and, more particularly, to an exhaust system having a uniform flow at varying engine speeds.

BACKGROUND

A typical exhaust after treatment system for an internal combustion engine may involve the placement of a catalyst treatment device in close proximity to the exhaust manifold of the internal combustion engine. This catalyst treatment device, referred to as a close-coupled catalytic converter, minimizes thermal loss in the exhaust gas, between the engine and the device, resulting in higher temperatures and quicker catalytic activation since the catalyst compounds that are typically used for treating engine exhaust gas operate best at temperatures in excess of 350° C.

Internal combustion engines that utilize a compressor such as an exhaust driven turbocharger to compress the combustion air charge, may be configured such that exhaust gas exiting the engine is conducted directly into, and through, the exhaust driven turbocharger. For greatest thermal efficiency, it may be desirable to locate a close-coupled catalytic converter directly adjacent to the outlet of the exhaust driven turbocharger in order to minimize the length of the exhaust gas passage therebetween; and resultant thermal load that must be overcome.

In such closely coupled arrangements, exhaust gas exiting the exhaust driven turbocharger during low speed operation may include a rotational or swirling component that migrates towards the outer circumference of the exhaust gas passage. As a result, upon reaching the inlet face of the catalyst substrate of the close coupled catalytic converter, the distribution of exhaust gas across the inlet face may be concentrated towards the outer circumference resulting in inefficient exhaust gas flow through the substrate. Such uneven flow of exhaust gas through the substrate may reduce the conversion efficiency of the exhaust treatment device.

SUMMARY

In an exemplary embodiment of the invention, an exhaust system configured to receive exhaust gas from an internal combustion engine comprises an exhaust driven turbocharger having an outlet and a flanged portion that extends about the outlet, an exhaust treatment device comprising a rigid canister having an inlet cone that includes an integral inlet flange defining an the inlet opening of the exhaust treatment device and configured to define a seal with the flanged portion that extends about the outlet of the exhaust driven turbocharger and a substrate disposed within the rigid canister through which the exhaust gas flows. An exhaust gas passage, defined by the turbocharger outlet and the inlet opening of the exhaust treatment device fluidly couples the exhaust driven turbocharger and the exhaust treatment device and allows for the passage of exhaust gas therebetween and a flow modifier comprising a radially inwardly extending wall portion extend from an inner wall of the exhaust gas passage and directs the exhaust gas away from an outer radius of the exhaust gas passage as exhaust gas enters the inlet cone of the exhaust treatment device to evenly distribute the exhaust gas across the an inlet face of the substrate.

In another exemplary embodiment of the invention, an internal combustion engine having an exhaust system configured to receive exhaust gas therefrom comprises an exhaust driven turbocharger, in fluid communication with the exhaust system, for receipt of exhaust gas from the internal combustion engine, and having an outlet and a flanged portion that extends about the outlet. An exhaust treatment device comprising a rigid canister having an inlet cone that includes an integral inlet flange defining an the inlet opening of the exhaust treatment device and configured to define a seal with the flanged portion that extends about the outlet of the exhaust driven turbocharger for receipt of exhaust gas therefrom. A catalyst coated substrate is disposed within the rigid canister through which the exhaust gas flows. An exhaust gas passage, defined by the turbocharger outlet and the inlet opening of the exhaust treatment device, fluidly couples the exhaust driven turbocharger and the exhaust treatment device and allows for the passage of exhaust gas therebetween and, a flow modifier comprises a radially inwardly extending wall portion that extends from an inner wall of the exhaust gas passage and directs the exhaust gas away from an outer radius of the exhaust gas passage as exhaust gas enters the inlet cone of the exhaust treatment device to evenly distribute the exhaust gas across the an inlet face of the catalyst coated substrate

BRIEF DESCRIPTION OF THE DRAWINGS

Other objects, features, advantages and details appear, by way of example only, in the following detailed description of the embodiments, the detailed description referring to the drawings in which.

DESCRIPTION OF THE EMBODIMENTS

Figure 1:
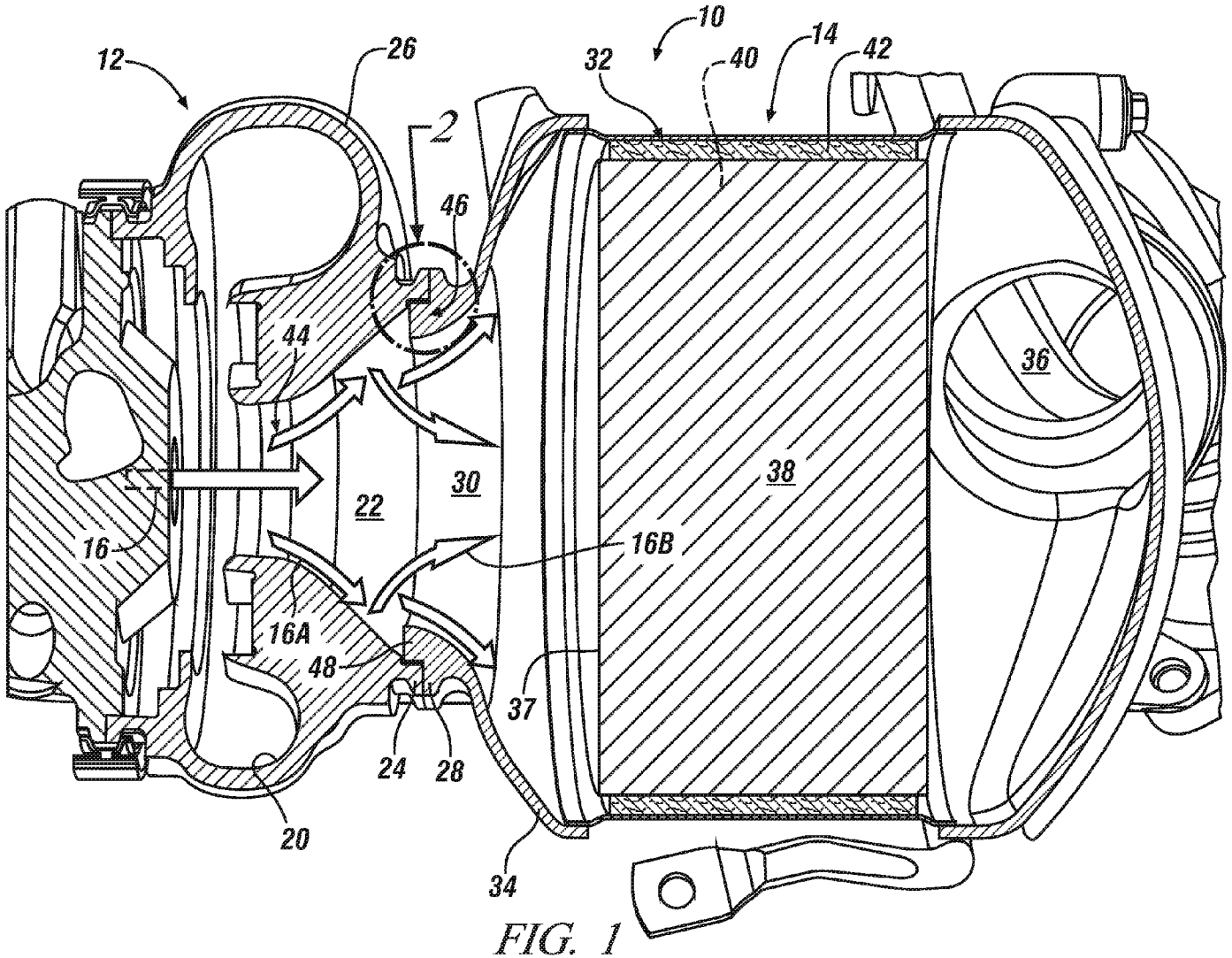
FIG. 1 is a partial, cross-sectional view of an exhaust system of an internal combustion engine.

The following description is merely exemplary in nature and is not intended to limit the present disclosure, its application or uses. It should be understood that throughout the drawings, corresponding reference numerals indicate like or corresponding parts and features.

Referring to FIG. 1, in an exemplary embodiment a portion of an exhaust system 10 of an internal combustion engine (not shown) includes an exhaust driven turbocharger 12 and a close-coupled exhaust treatment device 14. The exhaust driven turbocharger utilizes excess energy in the exhaust gas expelled from the internal combustion engine to drive a compressor (not shown) for the purpose of compressing the intake air charge which is delivered to an intake system (not shown) of the engine during operation thereof. Exhaust gas 16 rotates a turbine wheel (not shown) as it expands through a turbine scroll 20 and to a turbocharger outlet 22. The turbocharger outlet 22 may comprise a flanged portion 24 that is integral with the turbocharger housing 26 and extends about the turbocharger outlet 22. The flanged portion 24 is configured define a seal with a similarly configured inlet flange 28 that extends about an inlet opening 30 of the exhaust treatment device 14.

In an exemplary embodiment, the exhaust treatment device 14 may comprise a rigid canister 32 having an inlet cone 34 and an exhaust gas outlet 36. The inlet cone 34 may include the integral inlet flange 28 that defines the inlet opening 30 of the exhaust treatment device 14. Disposed within the rigid canister 32 between the inlet opening 30 and the exhaust gas outlet 36 is a substrate 38 through which the exhaust gas 16 flows. A catalyst compound 40 may be disposed on the surface of the substrate 38 and aids in the conversion or reduction of various regulated exhaust gas components. In an exemplary embodiment, as the exhaust gas 16 traverses the length of the catalyst coated substrate 38 a precious metal or Platinum group metal catalyst compound, including platinum group metals such as platinum (Pt), palladium (Pd), rhodium (Rh) or other suitable oxidizing catalysts, or combination thereof, catalyzes the oxidation of carbon monoxide ("CO") to carbon dioxide ("$CO_2$") in the presence of oxygen ("O2"), as well as catalyzing the oxidation of various hydrocarbons, including gaseous HC and liquid HC particles including unburned fuel or oil, as well as HC reductants that may have been introduced into the exhaust gas 16, to form $H_20$. Other catalyst compounds may also be utilized for the treatment of other exhaust gas constituents without deviating from the scope of the invention. A substrate support such as insulating mat 42 may be disposed between the substrate 38 and the rigid canister 32 to protect the substrate from shock and reduce the transfer of heat out of the exhaust treatment device 14.

Figure 2:
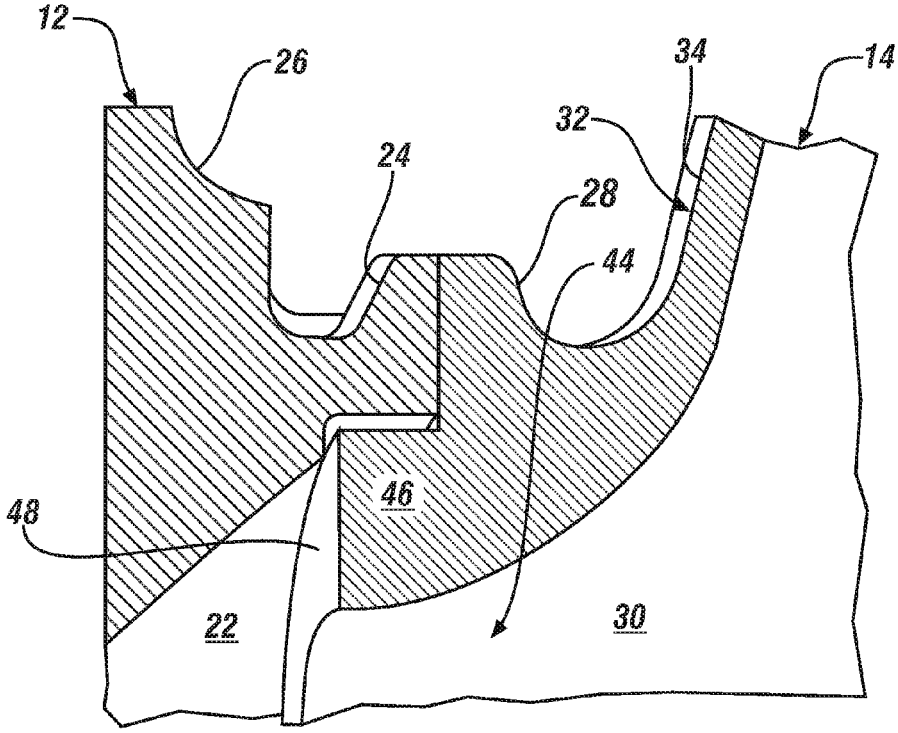
FIG. 2 is an enlarged view of a portion of the exhaust system of FIG. 1 taken at Circle 2.

Referring now to FIGS. 1 and 2, in an exemplary embodiment the turbocharger outlet 22 and the inlet opening 30 of the rigid canister 32 together define an exhaust gas passage 44 that fluidly couples the two devices and allows for the passage of exhaust gas 16 therethrough. When the internal combustion engine and, thus, the exhaust driven turbocharger 12 is operated at lower speeds (idle or no-load for example), the exhaust gas 16 may exit the turbocharger outlet 22 with a rotational or swirling component 16A, that migrates towards the outer radius of the exhaust gas passage 44. A flow modifier 46 comprising a radially inwardly extending wall portion 48 extends from the inner wall of the exhaust gas passage 44 and directs the outwardly migrating exhaust gas flow 16A away from the outer circumference of the exhaust gas passage and into a more evenly distributed flow path 16B as the exhaust gas 14 enters the inlet cone 34 of the exhaust treatment device 14 to thereby evenly distribute the exhaust gas 16 across the inlet face 37 of the substrate 38. In an exemplary embodiment, the flow modifier 46 is constructed integrally with the inlet flange 28 of the inlet cone 34 and may extend completely about the circumference of the exhaust gas passage 44 or, only a portion thereof. More specifically, the radially inwardly extending wall member 48 of the flow modifier 46 may be segmented to allow a portion of the exhaust gas to migrate towards the outer radius of the exhaust gas passage 44.

Figure 3:
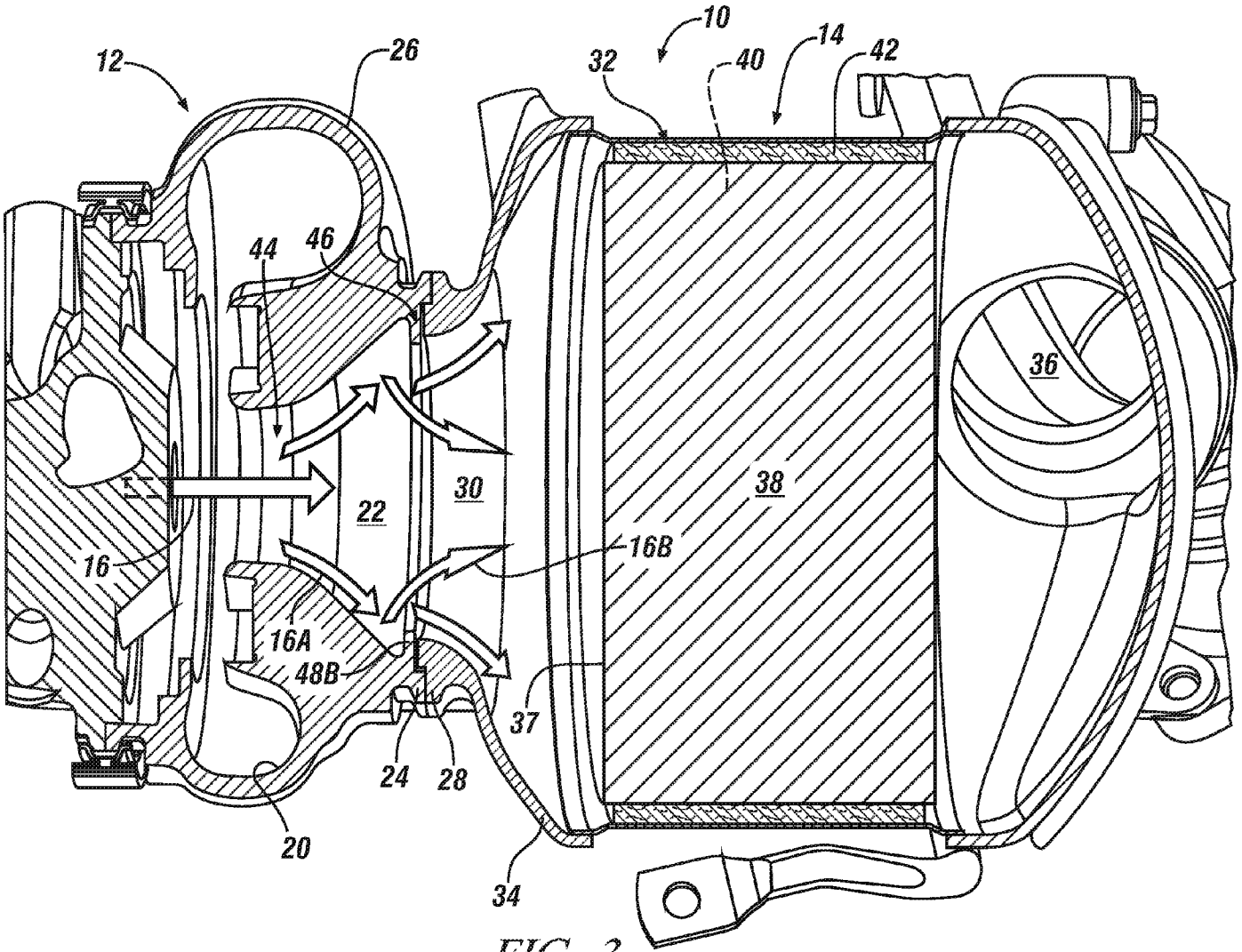
FIG. 3 is a partial, cross-sectional view of another embodiment of an exhaust system of an internal combustion engine.

Referring to FIG. 3, in an alternative embodiment of the invention, it is contemplated that the flow modifier 46 may comprise a radially inwardly extending wall portion 48B that is constructed integrally with the flanged portion 24 of the turbocharger outlet 22. The wall portion 48B may extend completely about the circumference of the exhaust gas passage 44 or, only a portion thereof. More specifically, the radially inwardly extending wall member 48B of the flow modifier 46 may be segmented to allow a portion of the exhaust gas to migrate towards the outer radius of the exhaust gas passage 44.

Figure 4:
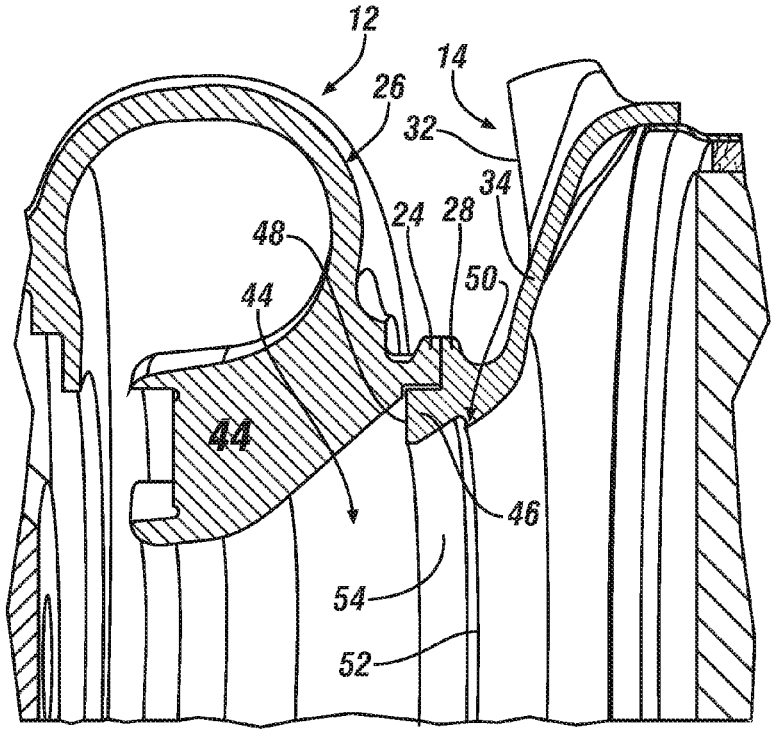
FIG. 4 is an enlarged view of a portion of the exhaust system of FIG. 1 taken at Circle 2 illustrating an additional embodiment of the invention.
Figure 5:
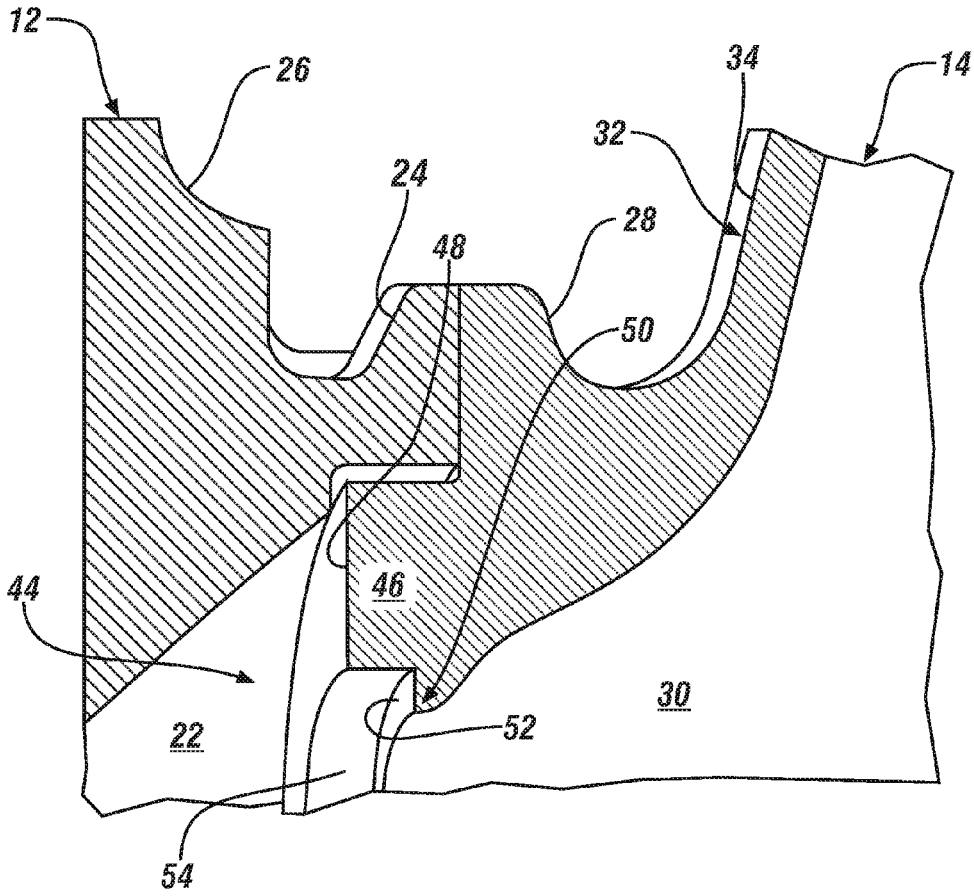
FIG. 5 is an enlarged view of a portion of the exhaust system of FIG. 1 taken at Circle 2 illustrating an additional embodiment of the invention.

Referring to FIGS. 4 and 5, in which like features already described in reference to other Figures are represented by like numerals, alternative embodiments of the invention, include the addition of a second flow modifier 50 that is positioned axially downstream (with respect to the exhaust gas flow direction) of the radially inwardly extending wall portions 48 or 48B. The second flow modifier 50 comprises a radially inwardly extending wing or wall portion 52 that extends from the inner wall 54 of the flow modifier 46 and further redirects the outwardly migrating exhaust gas flow 16A away from the outer circumference of the exhaust gas passage 44 and into a more centralized and evenly distributed flow path 16B as the exhaust gas 16 enters the inlet cone 34 of the exhaust treatment device 14. In an exemplary embodiment, the second flow modifier 50 is constructed integrally with the flow modifier 46 and may extend completely about the circumference of the exhaust gas passage 44 or, only a portion thereof. More specifically, the radially inwardly extending wing or wall portions 48 or 48B of the second flow modifier 50 may be segmented to allow a portion of the exhaust gas 16 to migrate towards the outer radius of the exhaust gas passage 44.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying out this invention, but that the invention will include all embodiments falling within the scope of the application.

What is claimed is:

1. An exhaust system configured to receive exhaust gas from an internal combustion engine comprising:

an exhaust driven turbocharger having an outlet and a flanged portion that extends about the outlet;

an exhaust treatment device comprising a rigid canister having an inlet cone that includes an integral inlet flange defining an inlet opening of the exhaust treatment device and configured to define a seal with the flanged portion that extends about the outlet of the exhaust driven turbocharger;

a substrate disposed within the rigid canister through which the exhaust gas flows;

an exhaust gas passage, defined by the turbocharger outlet and the inlet opening of the exhaust treatment device, that fluidly couples the exhaust driven turbocharger and the exhaust treatment device and allows for the passage of exhaust gas therebetween; and a flow modifier comprising a radially inwardly extending wall portion that extends from an inner wall of the exhaust gas passage and directs the exhaust gas away from an outer radius of the exhaust gas passage as exhaust gas enters the inlet cone of the exhaust treatment device to evenly distribute the exhaust gas across the an inlet face of the substrate.

2. The exhaust system of claim 1, wherein the radially inwardly extending wall portion of the flow modifier is segmented to direct a portion of the exhaust gas towards the outer radius of the exhaust gas passage.

3. The exhaust system of claim 1, wherein the flow modifier is constructed integrally with the inlet flange of the inlet cone.

4. The exhaust system of claim 1, wherein the flow modifier is constructed integrally with the flanged portion of the turbocharger outlet.

5. The exhaust system of claim 1, further comprising a second flow modifier that is positioned axially downstream, with respect to the exhaust gas flow direction, of the radially inwardly extending wall portion of the flow modifier and further redirects the outwardly migrating exhaust gas flow away from the outer circumference of the exhaust gas passage and into a more evenly distributed flow path as the exhaust gas enters the inlet cone of the exhaust treatment device.

6. The exhaust system of claim 5, wherein the second flow modifier comprises a radially inwardly extending wing.

7. An internal combustion engine having an exhaust system configured to receive exhaust gas therefrom comprising:

an exhaust driven turbocharger, in fluid communication with the exhaust system, for receipt of exhaust gas from the internal combustion engine, and having an outlet and a flanged portion that extends about the outlet;

an exhaust treatment device comprising a rigid canister having an inlet cone that includes an integral inlet flange defining an inlet opening of the exhaust treatment device and configured to define a seal with the flanged portion that extends about the outlet of the exhaust driven turbocharger for receipt of exhaust gas therefrom;

a catalyst coated substrate disposed within the rigid canister through which the exhaust gas flows;

an exhaust gas passage, defined by the turbocharger outlet and the inlet opening of the exhaust treatment device, that fluidly couples the exhaust driven turbocharger and the exhaust treatment device and allows for the passage of exhaust gas therebetween; and a flow modifier comprising a radially inwardly extending wall portion that extends from an inner wall of the exhaust gas passage and directs the exhaust gas away from an outer radius of the exhaust gas passage as exhaust gas enters the inlet cone of the exhaust treatment device to evenly distribute the exhaust gas across the an inlet face of the catalyst coated substrate.

8. The internal combustion engine of claim 7, wherein the radially inwardly extending wall portion of the flow modifier is segmented to direct a portion of the exhaust gas towards the outer radius of the exhaust gas passage.

9. The internal combustion engine of claim 7, wherein the flow modifier is constructed integrally with the inlet flange of the inlet cone.

10. The internal combustion engine of claim 7, wherein the flow modifier is constructed integrally with the flanged portion of the turbocharger outlet.

11. The internal combustion engine of claim 7, further comprises a second flow modifier that is positioned axially downstream, with respect to the exhaust gas flow direction, of the radially inwardly extending wall portion of the flow modifier and further redirects the outwardly migrating exhaust gas flow away from the outer circumference of the exhaust gas passage and into a more evenly distributed flow path as the exhaust gas enters the inlet cone of the exhaust treatment device.

12. The internal combustion engine of claim 11, wherein the second flow modifier comprises a radially inwardly extending wing.

* * * * *